United States Patent [19]

Maguire, Jr. et al.

[11] 4,162,987

[45] Jul. 31, 1979

[54] ENZYME-CONTAINING AUTOMATIC DISHWASHING DETERGENT COMPOSITION

[75] Inventors: Edward J. Maguire, Jr.; Eugene J. Pancheri, both of Cincinnati, Ohio

[73] Assignee: The Procter & Gamble Company, Cincinnati, Ohio

[21] Appl. No.: 869,881

[22] Filed: Jan. 16, 1978

Related U.S. Application Data

[63] Continuation of Ser. No. 699,416, Jun. 24, 1976, abandoned.

[51] Int. Cl.[2] ..... C11D 3/37

[52] U.S. Cl. ..... 252/135; 252/174.12; 252/174.15; 252/174.21; 252/174.16; 252/DIG. 1; 252/163; 252/535; 252/DIG. 12

[58] Field of Search ..... 252/89, DIG. 12, DIG. 1; 195/31 R, 63, 62, 65, 60

[56] References Cited

U.S. PATENT DOCUMENTS

| | | | |
|---|---|---|---|
| B 310,740 | 1/1975 | Barrat | 252/DIG. 12 |
| 3,682,842 | 8/1972 | Innerfield | 252/89 X |
| 3,717,550 | 2/1973 | Ziffer | 195/63 |
| 3,723,250 | 3/1973 | Aunstrup et al. | 195/62 |
| 3,825,498 | 7/1974 | Altenschopfer et al. | 252/DIG. 12 |
| 3,931,034 | 1/1976 | Inamorato et al. | 252/89 X |
| 3,933,672 | 1/1976 | Bartolotta et al. | 252/89 X |
| 3,960,665 | 6/1976 | Villadsen | 195/65 X |

FOREIGN PATENT DOCUMENTS

| | | | |
|---|---|---|---|
| 1275301 | 5/1972 | United Kingdom | 252/DIG. 12 |

*Primary Examiner*—Mayer Weinblatt

*Attorney, Agent, or Firm*—Edmund F. Gebhardt; Thomas H. O'Flaherty; Richard C. Witte

[57] ABSTRACT

Automatic dishwashing compositions comprising a nonionic surface-active agent and a binary enzyme system are disclosed. The enzyme system comprises a proteolytic enzyme having a proteolytic activity of 80 to 100% of maximum activity when measured at pH 12 using the Anson hemoglobin method carried out in the presence of urea, and an amylolytic enzyme. Preferred amylolytic enzymes are those which show an amylolytic activity of more than 50% of maximum activity when measured at pH 8 by the SKB method at 37° C. The composition may be made in granular, pasty, or gelled form, and may contain other components usually found in automatic dishwashing compositions. A process for washing dishes utilizing the compositions of the present invention is also disclosed.

9 Claims, No Drawings

ENZYME-CONTAINING AUTOMATIC DISHWASHING DETERGENT COMPOSITION

This is a continuation of application Ser. No. 699,416, filed June 24, 1976, now abandoned.

BACKGROUND OF THE INVENTION

This invention relates to detergent cleaning compositions which are particularly suitable for use in automatic dishwashers. In particular, the compositions herein comprise a nonionic surface-active agent, and an effective amount of an enzyme mixture which comprises a proteolytic enzyme having a proteolytic activity of 80 to 100% of maximum activity when measured at pH 12 using the Anson hemoglobin method carried out in the presence of urea, and an amylolytic enzyme, wherein the ratio of said proteolytic enzyme to said amylolytic enzyme is from about 4:1 to about 1:4 by weight. The compositions of this invention are capable of providing, during conventional use, markedly enhanced cleaning performance for a range of soils, in comparison with compositions containing the more conventionally used enzymes. The instant compositions, in addition to the essential components, preferably comprise conventional dishwashing composition additives, in the art-established levels to achieve their known function. Examples of such additives include sodium silicate solids, sodium carbonate, sodium bicarbonate, sodium sulfate, and sodium phosphate. It is noteworthy that the compositions herein are capable of providing excellent dishwashing performance in the presence of a reduced level of phosphorus-containing detergent builders, or in essentially phosphate-free compositions as well as in fully built phosphate compositions.

Conventional automatic dishwashing compositions usually contain a low foaming surface-active agent, a chlorine bleach, alkaline builder materials, and usually minor ingredients and additives. The incorporation of chlorine bleaches requires special processing and storage precautions to protect composition components which are subject to deterioration upon direct contact with the active chlorine. The stability of the chlorine bleach is also critical and raises additional processing and storage difficulties. In addition, it is known that automatic dishwasher detergent compositions may tarnish silverware and damage metal trim on china as a result of the presence of a chlorine-containing bleach therein. Accordingly, there is a standing desire to formulate detergent compositions for use in automatic dishwashing operations which are free of active chlorine and which are capable of providing overall hard surface cleaning and appearance benefits comparable to or better than active chlorine-containing detergent compositions. This reformulation is particularly delicate in the context of automatic dishwashing operations, since during those operations, the active chlorine prevents the formation and/or deposition of troublesome protein and protein-grease complexes on the hard dish surfaces and no surfactant system currently known is capable of adequately performing that function.

The disclosures of U.S. Pat. No. 3,549,539 to Mallows, incorporated herein by reference, relates to machine dishwashing powders containing a nonyl phenol-5-EO or a condensation product of a random $C_{11}$ to $C_{15}$ secondary alcohol and ethylene oxide with an HLB (hydrophilic-lipophilic balance) value between 11.5 and 13.5 and a polyethylene oxide-polypropylene oxide condensate that consists of between 5 and 25% polyethylene oxide and 95 to 75% polypropylene oxide and has a molecular weight between 1500 and 2700. It is disclosed that in addition to the above surfactant combination the machine dishwashing powder will normally contain from 5 to 30% of a silicate, such as sodium metasilicate, from 5 to 30% of an oxidizing agent, from 25 to 70% of a calcium ion sequestrant and from 1 to 20% of an inorganic filler salt, such as sodium carbonate or sodium sulfate. The oxidizing agent included may be chlorinated sodium orthophosphate, chlorinated isocyanurate and perborate possibly with a copper catalyst or an organic activator. Additional disclosures relative to bleach-containing detergent compositions for use in automatic dishwashers can be found in, for example, U.S. Pat. Nos. 3,410,804; 3,390,092; 3,248,330; and 3,595,968, incorporated herein by reference.

Various attempts have been made to formulate bleach-free low foaming detergent compositions for automatic dishwashing machines, containing particular low foaming nonionics, builders, and filler materials. As an example, U.S. Pat. No. 3,022,250 to Grifo, incorporated herein by reference, relates to low-sudsing detergent compositions especially adapted for automatic dishwashing machines, containing a phenol having therein an aliphatic substituent with an average of 9 carbon atoms per chain and a second substituent comprising condensed ethylene oxide in an average number of four molecules per molecule of phenol, together with builder consisting essentially of a mixture of sodium metasilicate and sodium tripolyphosphate in the proportion of one part of metasilicate to three parts of tripolyphosphate, the builders being present in the proportion of 95 parts of builder mixture to 5 parts of alkyl phenyl ethylene oxide. Thus, the art has recognized the desirability of formulating an effective detergent composition for use in automatic dishwashers, which does not require the inclusion therein of a chlorine-containing bleach.

Another problem recognized in the art is that of effectively incorporating enzymes in a highly alkaline detergent composition for use in an automatic dishwasher, while preventing the degradation of the enzymes, during use, and thereby their loss of cleaning effectiveness. U.S. Pat. No. 3,472,783; to Smillie, recognizes that the addition of an enzyme to an aqueous, alkaline detergent composition will result in the degradation, and thereby the loss of effectiveness, of the enzyme. The compositions of that patent do not contain alkaline builder salts in order to alleviate the enzyme degradation problem.

French Pat. No. 2,102,851 to Colgate-Palmolive, pertains to rinsing and washing compositions for use in automatic dishwashers. The compositions disclosed have a pH of about 6 to 7 and contain an amylolytic and, if desired, a proteolytic enzyme, which have been prepared in a special manner from animal pancreas and which exhibit a desirable activity at a pH in the range of about 6 to 7. German Pat. No. 2,038,103 to Henkel & Cie. relates to aqueous liquid or pasty cleaning compositions containing phosphate salts, enzymes and an enzyme stabilizing compound. U.S. Pat. No. 3,799,879 to Francke et al, teaches a detergent composition for cleaning dishes, with a pH of from 7 to 9 containing an amylolytic enzyme, and in addition, optionally a proteolytic enzyme.

Concurrently filed U.S. Patent application Ser. No. 669,415, entitled "Enzyme-Containing Automatic Dishwashing Detergent Composition", inventors Geoffrey Place and Edward J. Maguire, Jr., relates to bleach-free automatic dishwashing compositions comprising an alkoxylated nonionic surface-active agent, and particular enzymes, preferred ones of which exhibit a proteolytic activity of at least 80% of maximum activity when measured at pH 12 using the Anson hemoglobin method carried out in the presence of urea.

U.S. Pat. No. 3,827,938 to Aunstrup et al, discloses specific proteolytic enzymes which exhibit high enzymatic activities in highly alkaline systems. Similar disclosures are found in British Patent Specification No. 1,361,386, to Novo Terapeutisk Laboratorium A/S. British Patent Specification No. 1,296,839, to Novo Terapeutisk Laboratorium A/S, discloses specific amylolytic enzymes which exhibit a high degree of enzymatic activity in alkaline systems.

Thus, while the prior art clearly recognizes the disadvantages of using aggressive chlorine bleaches in automatic dishwashing operations and also suggests bleach-free compositions made by leaving out the bleach component, said art disclosures are silent about how to formulate bleach-free automatic dishwashing compositions capable of providing superior performance during conventional use.

Accordingly, it is an object of this invention to formulate detergent compositions, which may be formulated without bleach, capable of providing superior cleaning and antiredeposition characteristics in automatic dishwashing operations.

It is an additional object of this invention to effectively and stably incorporate enzymes in detergent compositions for use in automatic dishwashing operations with a view toward optimizing cleaning performance of the compositions.

It is a further object of this invention to incorporate a unique enzyme mixture in detergent compositions for use in automatic dishwashing operations capable of providing at least equal or better performance than automatic dishwashing compositions commercially available now.

It is still a further object of the invention to provide enzyme containing compositions in a product form which reduces the tendency of the enzymes to become deactivated during the use of the product.

The above and other objects are now achieved by formulating a detergent composition for use in automatic dishwashing operations, comprising a nonionic surface-active agent and a select binary enzyme system.

SUMMARY OF THE INVENTION

This invention deals with bleach-free automatic dishwashing compositions comprising a nonionic surfactant and a binary enzyme mixture containing a specifically selected proteolytic enzyme and an amylolytic enzyme.

In more detail, the compositions of this invention comprise:

(a) at least about 0.5% by weight of nonionic surface-active agent; and (b) an effective amount of an enzyme mixture which comprises:

(1) a proteolytic enzyme having a proteolytic activity of 80% to 100% of maximum activity when measured at pH 12 using the Anson Hemoglobin method carrier out in the presence of urea; and (2) an amylolytic enzyme wherein said enzymes are present in a ratio of from about 4:1 to about 1:4 by weight, and wherein said enzyme mixture is present in such an amount that the final cleaning composition has an amylolytic activity of at least 150 Kilo Novo units per kilogram and a proteolytic activity of at least 6 Anson units per kilogram.

In a preferred embodiment, the surface-active agent is an alkoxylated nonionic surface-active agent wherein said alkoxy moiety is selected from the group consisting of ethylene oxide, propylene oxide, and mixtures thereof. The cleaning compositions of the present invention may also contain additional components which are normally found in automatic dishwashing detergent compositions.

In one embodiment of the invention, the composition is in the form of a solid, preferably granular, composition and comprises up to about 20% by weight of the nonionic surface-active agent.

In a second and preferred embodiment of the invention, the composition is in the form of a viscous liquid, slurry, foam, paste, or gel, and comprises from about 0.5% to about 55% by weight of the nonionic surface-active agent. It is generally important that automatic dishwashing machine products are retained, in the dishwashing machine, in some form of dispenser prior to use. The dispenser provided in most machines is not fluid tight and the product form of this second embodiment, therefore, should be such that the viscous liquid or paste does not leak from the dispenser.

It has been found that when enzymes are incorporated into granular products, there is a tendency toward deactivation of the enzyme because of leakage of water into the dispenser cup during the prewash cycle of a dishwashing machine. The water at least partially dissolves the product and creates a highly alkaline environment wherein the enzyme tends to lose its activity before entering the machine washing system itself.

Viscous liquid or paste-like products are less prone to this deactivation because of the significantly smaller surface area available to the leaked water. The enzyme is thus, to a large extent, protected in the bulk of the composition.

Generally, if the product is in liquid form, the liquid should be thixotropic (i.e., exhibit high viscosity when subjected to low stress and lower viscosity when subjected to high stress), or at least have a very high viscosity, e.g., in the range of 1,000 to 10,000,000 centipoise. Pasty compositions of the invention generally have viscosities of about 5,000 centipoise and up to several hundred million centipoise.

The detergent compositions of the present invention have a pH, in use, of from about 8.5 to 11.5, preferably from 9 to 11, most preferably from 9.5 to 10.5.

A process for washing dishes utilizing the compositions of the present invention is also claimed.

DETAILED DESCRIPTION OF THE INVENTION

The automatic dishwashing detergent compositions of the present invention comprise: (1) a nonionic surface-active agent; and (2) an effective amount of an enzyme mixture which comprises a specifically selected proteolytic enzyme exhibiting certain activity characteristics and an amylolytic enzyme, in a specified ratio. These essential components are discussed in detail hereinafter.

Unless stated to the contrary, the "percent" indications used herein stand for percentage by weight.

The surface-active component for use herein comprises at least about 0.5% of a nonionic surface-active agent. The surfactant level desirably in kept below about 20% in the case of a granular detergent composition. Using more than about 20% in the case of a granular detergent composition can contribute to a lumping and caking tendency of product. Preferred granular compositions contain from about 1% to about 10% of a nonionic surface-active agent.

In the case of a paste-like, gelled or viscous liquid product, higher surfactant levels may be tolerated. Thus, by choosing an appropriate nonionic surfactant system, along with small quantities of material such as solubilizers, thickeners, and the like, stable, easily dispensed compositions containing up to about 55% of the nonionic surface-active agent may be prepared. Preferred paste or gelled compositions contain from about 2.5% to about 25% of the nonionic surface-active agent.

Most commonly, nonionic surfactants are compounds produced by the condensation of an alkylene oxide, especially ethylene oxide (hydrophilic in nature) with an organic hydrophobic compound, which is usually aliphatic or alkyl aromatic in nature. The length of the hydrophilic polyoxyalkylene moiety which is condensed with any particular hydrophobic compound can be readily adjusted to yield a water-soluble compound having the desired degree of balance between hydrophilic and hydrophobic properties. A typical listing of the classes and species of such nonionic surfactants useful herein appears in U.S. Pat. No. 3,664,961, incorporated herein by reference.

Preferred nonionic surface-active agents include alkoxylated nonionic surface-active agents wherein the alkoxy moiety is selected from the group consisting of ethylene oxide, propylene oxide, and mixtures thereof. Ethylene oxide represents the preferred condensation partner. The alkylene oxide moiety is condensed with a nonionic base material according to techniques known in the art. All alkoxylated nonionic detergents which are normally known to be suitable for use in detergent technology can be used herein. Examples of such components include:

(1) The condensation product of one mole of a saturated or unsaturated, straight or branched chain carboxylic acid having from about 10 to about 18 carbon atoms with from about 5 to about 50 moles of ethylene oxide. The acid moiety can consist of mixtures of acids in the above delineated carbon atoms range or it can consist of an acid having a specific number of carbon atoms within this range. The condensation product of one mole of coconut fatty acid having the approximate carbon chain length distribution of 2% $C_{10}$, 66% $C_{12}$, 23% $C_{14}$, and 9% $C_{16}$ with 35 moles of ethylene oxide is a specific example of a nonionic containing a mixture of different chain lengths fatty acid moieties. Other specific examples of nonionics of this type are: the condensation product of one mole of palmitic acid with 40 moles of ethylene oxide; the condensation product of one mole of myristic acid with 35 moles of ethylene oxide; the condensation product of one mole of oleic acid with 5 moles of ethylene oxide; and the condensation product of one mole of stearic acid with 30 moles of ethylene oxide.

(2) The condensation products of one mole of a saturated or unsaturated, straight or branched chain alcohol having from about 10 to about 24 carbon atoms with from about 5 to about 50 moles of ethylene oxide. The alcohol moiety can consist of mixtures of alcohols in the above-delineated carbon atom range or it can consist of an alcohol having a specific number of carbon atoms within this range. The condensation product of one mole of coconut alcohol having the approximate chain length distribution of 2% $C_{10}$, 66% $C_{12}$, 23% $C_{14}$, and 9% $C_{16}$ with 45 moles of ethylene oxide ($CNAE_{45}$) is a specific example of a nonionic containing a mixture of different chain length alcohol moieties. Other specific examples of nonionics of this type are the condensation products of one mole of tallow alcohol with 9 and 20 moles of ethylene oxide respectively; the condensation products of one mole of lauryl alcohol with 35 moles of ethylene oxide; the condensation products of one mole of myristyl alcohol with 30 moles of ethylene oxide; and the condensation products of one mole of oleyl alcohol with 40 moles of ethylene oxide.

(3) Polyethylene glycols having a molecular weight of from about 1400 to about 30,000. For example, Dow Chemical Company manufactures these nonionics in molecular weights of 20,000, 9500, 7500, 4500, 3400, and 1450. All of these nonionics are waxlike solids which melt between 110° F. and 200° F.

(4) The condensation products of one mole of alkyl phenol wherein the alkyl chain contains from about 8 to about 18 carbon atoms with from about 4 to about 50 moles of ethylene oxide. Specific examples of these nonionics are the condensation products of one mole of decyl phenol with 40 moles of ethylene oxide; the condensation products of one mole of dodecyl phenol with 35 moles of ethylene oxide; the condensation products of one mole of tetradecyl phenol with 35 moles of ethylene oxide; and the condensation products of one mole of hexadecyl phenol with 30 moles of ethylene oxide.

(5) The ethoxylated surfactants disclosed in U.S. Patent Application Ser. Number 557,217, filed Mar. 10, 1975, inventor Jerome H. Collins, now abandoned incorporated herein by reference, consisting essentially of a mixture of compounds having at least two levels of ethylene oxide addition and having the formula: $R_1$—$R_2$—$O(CH_2CH_2O)_nH$, wherein $R_1$ is a linear alkyl residue and $R_2$ has the formula —$CHR_3CH_2$—wherein $R_3$ is selected from the group consisting of hydrogen and mixtures thereof with not more than 40% by weight of lower alkyl, wherein $R_1$ and $R_2$ together form an alkyl residue having a mean chain length in the range of 8–15 carbon atoms, at least 65% by weight of said residue having a chain length within ±1 carbon atom of the mean, wherein $3.5<n<6.5$, provided that the total amount of components in which $n=0$ is not greater than 5% by weight and the total amount of components in which $n=2$–7 inclusive is not less than 63% by weight, and the hydrophilic-lipophilic balance (HLB) of said ethoxylate material is in the range from 9.5–11.5, said surfactant composition being otherwise free of nonionic surfactants having an HLB outside of said range.

Low-foaming alkoxylated nonionics are preferred although other (than low-foaming) alkoxylated nonionics can be used without departing from the spirit of this invention. Examples of nonionic low-foaming surface-active components include the condensation products of benzyl chloride and an ethoxylated alkyl phenol wherein the alkyl group has from about 6 to about 12 carbon atoms and wherein from about 12 to about 20 ethylene oxide molecules have been condensed per mole of alkyl phenol; polyetheresters of the formula $$(ClC_6H_4)_2CHCO_2(CH_2.CH_2O)_xR$$

wherein x is an integer from 4 to 20 and R is a lower alkyl group containing not more than 4 carbon atoms, for example a component having the formula $$(ClC_6H_4)_2CHCO_2(CH_2CH_2O)_{15}.CH_3;$$

the polyalkoxylation products of alkyl phenol, for example, the polyglycol alkyl phenol ethers containing an alkyl group having at least 6 and, normally, from about 8 to about 20 carbon atoms and having a molar ratio of ethylene oxide to condensate of about 7.5; 9.0; 11.5; 20.5; and 30. The alkyl group can, for example, be represented by diisobutylene; di-amyl; polymerized propylene; iso-octyl; and nonyl.

Additional examples of effective low-foaming nonionics include: the polyalkylene glycol condensates of U.S. Pat. No. 3,048,548, hereby incorporated by reference, having alternating hydrophilic oxyethylene chains and hydrophobic oxypropylene chains wherein the weight of the terminal hydrophobic chains, the weight of the middle hydrophobic unit and the weight of the linking hydrophilic units each represent about one-third of the condensate; the de-foaming nonionic surfactants disclosed in U.S. Pat. No. 3,382,178, incorporated herein by reference, having the general formula $Z[(OR)_nOH]_z$ wherein Z is alkoxylatable material, R is a radical derived from an alkylene oxide which can be ethylene and propylene and n is an integer from, for example, 10 to 2000 or more and z is an integer determined by the number of reactive oxyalkylatable groups. Z can be represented by normal biodegradable alcohols such as, for example, obtained by reduction of fatty acids derived from coconut oil, palm kernel oil, tallow and also those obtained from petroleum such as, for example, the mixtures of $C_{10}$ to $C_{18}$ straight-chain primary alcohols; the nonionic surface-active agents of U.S. Pat. No. 3,549,539 being a mixture of nonylphenol-5-EO or the condensation product of a random $C_{11}$ to $C_{15}$ secondary alcohol and ethylene oxide having an HLB value between 11.5 and 13.5; and a polyethylene oxide/polypropylene oxide condensate that consists of between 5 and 25% polyethylene oxide and 95 and 75% polypropylene oxide and has a molecular weight between 1500 and 2700; the conjugated polyoxyalkylene compounds described in U.S. Pat. No. 2,677,700, incorporated herein by reference, corresponding to the formula:

$$Y(C_3H_6O)_n(C_2H_4O)_mH$$

wherein Y is the residue of organic compound having from about 1 to 6 carbon atoms and one reactive hydrogen atom, n has an average value of at least about 6.4, as determined by hydroxyl number and m has a value such that the oxyethylene portion constitutes about 10 to 90 weight percent of the molecule; the conjugated polyoxyalkylene compounds described in U.S. Pat. No. 2,674,619, incorporated herein by reference, having the formula:

$$Y[(C_3H_6O)_n(C_2H_4O)_mH]_x$$

wherein Y is the residue of an organic compound having from about 2 to 6 carbon atoms and containing x reactive hydrogen atoms in which x has a value of at least about 2, n has a value such that the molecular weight of the polyoxypropylene hydrophobic base is at least about 900 and m has a value such that the oxyethylene content of the molecule is from about 10 to 90 weight percent. Compounds falling within the scope of the definition for Y include, for example, propylene glycol, glycerine, pentaerythritol, trimethylolpropane, ethylenediamine and the like. The oxypropylene chains optionally, but advantageously, contain small amounts of ethylene oxide and the oxyethylene chains also optionally, but advantageously, contain small amounts of propylene oxide.

Additional conjugated polyoxyalkylene surface-active agents which are advantageously used in the compositions of this invention correspond to the formula:

$$P[(C_3H_6O)_n(C_2H_4O)_mH]_x$$

wherein P is the residue of an organic compound having from about 8 to 18 carbon atoms and containing x reactive hydrogen atoms in which x has a value of 1 or 2, n has a value such that the molecular weight of the polyoxypropylene portion is at least about 58 and m has a value such that the oxyethylene content of the molecule is from about 10 to 90 weight percent and the formula:

$$P[(C_2H_4O)_n(C_3H_6O)_mH]_x$$

wherein P is the residue of an organic compound having from about 8 to 18 carbon atoms and containing x reactive hydrogen atoms in which x has a value of 1 or 2, n has a value such that the molecular weight of the polyoxyethylene portion is at least about 44 and m has a value such that the oxypropylene content of the molecule is from about 10 to 90 weight percent. In either case the oxypropylene chains may contain optionally, but advantageously, small amounts of ethylene oxide and the oxyethylene chains may contain also optionally, but advantageously, small amounts of propylene oxide.

Preferred nonionic surfactants for use in the present invention include the mono- and polyalkoxy-substituted surfactants having the terminal hydroxyl of the alkoxy group acylated by certain monobasic acids ("capped" surfactants), described in U.S. Patent application Ser. No. 621,456, Williams, filed Oct. 10, 1975, incorporated herein by reference.

Highly preferred alkoxylated nonionics for use herein include the condensation product of one mole of tallow alcohol with from about 6 to about 20 moles, especially 9 moles of ethylene oxide; the alkoxylate commercially available under the tradename PLURADOT HA-433 ® Wyandotte Chemical Corp., which has a molecular weight in the range from 3700–4200 and contains about 3% monostearyl acid phosphate suds suppressant; and also the condensation product of $C_{14-15}$ alcohol with from 5 to 17 moles, particularly 7–9 moles, of ethylene oxide. An example of such a surfactant is commerically available as NEODOL 45–7, available from Shell Chemical Corp., which is the condensation product of $C_{14-15}$ alcohol with 7 moles of ethylene oxide per molecule of alcohol.

The enzyme component of the present detergent compositions is an effective amount of an enzyme mixture which comprises a proteolytic enzyme having a proteolytic activity of 80% to 100% of maximum activity when measured at pH 12 using the Anson Hemoglobin method carried out in the presence of urea, and an amylolytic enzyme. The enzyme mixture is used in such an amount such that the final cleaning composition has an amylolytic activity of at least 150 Kilo Novo units per kilogram and a proteolytic activity of at least about 6.0 Anson units per kilogram. This corresponds roughly to detergent compositions comprising from about 0.001% to about 5% of the enzyme mixture, utilizing generally available commercial enzyme preparations. More preferably, this corresponds to detergent compositions comprising from about 0.1% to about 1.5% of the enzyme mixture. The ratio of amylolytic to proteolytic enzyme in the enzyme mixture is from about 4:1 to about 1:4 by weight. Preferably the ratio of amylolytic to proteolytic enzyme in the enzyme mixture is from about 2:1 to about 1:2, and most preferably the enzymes are present in the mixture in a ratio of about 1:1.

Enzymes are important and essential components of biological systems, their function being to catalyze and facilitate organic (and inorganic) reactions. For example, enzymes are essential to metabolic reactions occurring in animal and plant life.

All enzymes are proteins which, in general, are made of many amino acids of the L configuration linked by an amide bond between the carboxyl group of one amino acid and the alpha-amino of another (peptide bond). It is also known that some proteolytic enzymes have crucial dependencies on nonprotein prosthetic groups or cofactors. A polypeptide is normally considered to be a protein when it contains minimally from about 40 to 75 peptide bonds. A cofactor can be termed as a substrate required for manifestation of enzymatic activity and which emerges unchanged from the reaction. These cofactors apparently are not involved, however, in the catalytic events of enzyme function. Rather, their role seems to be one of maintaining the enzyme in an active configuration. Enzymes are considered to exhibit their catalytic activity by virtue of three general characteristics: the formation of noncovalent complex with the substrate; substrate specificity; and catalytic activity. Many compounds may bind to an enzyme, but only certain types will lead to subsequent reaction; the latter are called substrates and they satisfy the particular enzyme specificity requirement. Materials that bind but do not thereupon chemically react can affect the enzymatic reaction either in a positive or negative way. For example, unreacted species called inhibitors, can alter the enzymatic activity.

In detergent technology, enzymes aid and augment the removal of soils from objects to be cleaned. The enzymatic action may result from a series of individual chemical reactions inclusive of hydrolysis, oxidation, and substitution. As pointed out above, specific enzymes have a specific function either in terms of a particular chemical reaction or a particular kind of soil. Thus, the art has indicated that various types of enzymes may be combined in order to obtain cleaning power over a broad spectrum of soils. However, it has now been found that a mixture of specially selected proteolytic enzymes together with an amylolytic enzyme will impart a unique, improved cleaning benefit in an automatic dishwashing detergent compostion.

The proteolytic enzymes which may be used in the present invention are those which exhibit a proteolytic activity of 80% to 100% of maximum activity when measured at pH 12 using the Anson Hemoglobin method carried out in the presence or urea. The Anson Hemoglobin method is described in the *Journal of General Physiology,* Vol. 22, pp. 79–89 (1939). These enzymes may be obtained by the aerobic cultivation of protease-forming species of the genus bacillus on a nutrient medium having a pH within the range of 9 to 11 and maintaining, during the major period of said cultivation, a pH in the nutrient medium between 7.5 and 10.5. A method for the preparation of such enzymes is given in British Patent Specification No. 1,234,784.

Proteolytic enzymes suitable for use in the present invention are described in the disclosure of British Patent Specification No. 1,361,386. Preferred proteolytic enzymes are the strain numbers C372, C303, C367, and C370; all of these latter references correspond to bacterium strains which have been deposited at the National Collection of Industrial Bacteria, Torry Research Station, Aberdeen, Scotland (NCIB). NCIB numbers for enzymes useful in the present invention are given in the specification of Belgian Pat. No. 721,730. Listed hereafter are, as examples, the NCIB numbers for the bacterium strain producing preferred enzymes species suitable for being used with the compositions of this invention. C372 corresponds to NCIB 10 317; C303 corresponds to NCIB 10 147; C367 corresponds to NCIB 10 313; and C370 corresponds to NCIB 10 315. The full series of NCIB numbers can be found on pages 4, 5, and 6 of the specification of the Belgian patent referred to hereinbefore.

Another preferred enzyme for use in the compositions of the present invention is that cultivated from the microorganism of Bacillus firmus strain NRS 783, as described in U.S. Pat. No. 3,827,938, Aunstrup et al, issued Aug. 6, 1974, incorporated herein by reference. Bacillus firmus strain NRS 783 may be obtained from the U.S. Department of Agriculture, Agricultural Research Service, Peoria, Ill., as strain NRRL B 1107 Particularly preferred proteolytic enzymes are those cultivated from strains NCIB 10147 and NRRL B 10017 and mixtures thereof.

Preferred, commercially available proteolytic enzymes for use in the compositions of the present invention, are available under the tradenames SP-72 (ESPERASE) and SP-88, produced and marketed by Novo Industrial A/S, Copenhagen, Denmark.

The particularly selected proteolytic enzyme is combined with an amylolytic enzyme, derived from bacteria or fungi. Preferred amylolytic enzymes are those which exhibit an amylolytic activity of greater than 50% of maximum activity when measured at pH 8 by the SKB method at 37° C. The SKB method is described in *Cereal Chemistry,* Vol. 16, p. 712 (1939), and British Patent Specification No. 1,296,839.

Preferred amylolytic enzymes for use in the present invention include Monsanto DA 10, commercially available from Monsanto; RAPIDASE, available from Societé Rapidasé, France; MILEZYME, available from Miles Laboratories, Elkhart, Ind.; and BAN, available from Novo Industrials A/S. Particularly preferred amylolytic enzymes are those prepared and described in British Patent Specification No. 1,296,839, cultivated from the strains of bacillus lichenformis NCIB 8061; NCIB 8059; ATCC (America Type Culture Collection) 6334; ATCC 6598; ATCC 11945; ATCC 8480; and ATCC 9945A. A particularly preferred, commercially available amylolytic enzyme, is produced and distributed under the tradename SP-95 (Termamyl), by Novo Industria A/S, Copenhagen Denmark.

The proteolytic and amyloloytic enzymes, described above, are combined in a ratio of from about 4:1 to about 1:4 by weight, and the enzyme mixture is present in the detergent composition in such an amount that the detergent composition has an amylolytic activity of at least 150 Kilo Novo units per kilogram, preferably at least 300 Kilo Novo units/kg., and a proteolytic activity of at least 6.0 Anson units per kilogram. The amylolytic activity is determined in Kilo Novo units by a procedure which is a modification of the SKB method without the addition of beta-amylase. The procedure for determining the activity in Novo units is described in U.S. Pat. No. 3,931,034, Inamorato et al, issued Jan. 6, 1976, incorporated herein by reference. The proteolytic activity of the mixture is measured in Anson units, which is that amount of proteolytic enzyme that degrades hemoglobin under the standard conditions as described by M. L. Anson in the *Journal of General Physiology,* Vol. 22, supra.

The compositions of this invention frequently comprise a suds suppressing agent for the purpose of inhibiting the formation of excessive amounts of foam, which can impair the mechanical operation of the dishwashing machine, due to a lowering of the pressure at which the washing liquor is forced against the hard surfaces to be washed. Of course, the final selection of the suds suppressing agent depends upon, at least in part, the qualitative and quantitative characteristics of the particular nonionic surface-active agent which is utilized in the automatic dishwashing composition. In addition, food residues, especially protinaceous food residues, exhibit suds boosting properties and therefore preferably command the presence of an effective suds regulating agent.

Suds regulating components are normally used in an amount of from about 0.001% to about 5%, preferably from about 0.05% to about 3%, and especially from about 0.10% to about 1%. The suds suppressing agents known to be suitable in the detergent context can be used in the compositions herein.

Preferred suds suppressing additives are described in U.S. Pat. No. 3,933,672, Bartolotta et al, issued Jan. 20, 1976, incorporated herein be reference, relative to a silicone suds controlling agent. The silicone material can be represented by alkylated polysiloxane materials such as silica aerogels and xerogels, and hydrophobic silicas of various types. The silicone material may be described as siloxane having the formula:

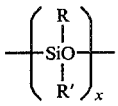

wherein x is from about 20 to about 2,000 and R and R′ are each alkyl or aryl groups, especially methyl, ethyl, propyl, butyl, and phenyl. The polydimethyl siloxanes (R and R′ are methyl) having a molecular weight within the range of from about 200 to 200,000, and higher, are all useful as suds controlling agents. Additional suitable silicone materials, wherein the side chain groups are R and R′ are alkyl, aryl, or mixed alkyl and aryl hydrocarbyl groups, exhibit useful suds controlling properties. Examples of such ingredients include diethyl-, dipropyl-, dibutyl-, metyl and ethyl-, phenylmethyl polysiloxanes and the like. Additional useful silicone suds controlling agents can be represented by a mixture of an alkylated siloxane, as referred to above, and solid silica. Such mixtures are prepared by affixing the silicone to the surface of the solid silica. A preferred silicone suds controlling agent is represented by a hydrophobic silinated (most preferably trimethylsilanated) silica having a particle size in the range of from about 10 millimicrons to 20 millicrons in a specific surface area above about 50 square meters per gram, intimately admixed with dimethyl silicone fluid having a molecular weight in the range of from about 500 to about 200,000 at a weight ratio of silicone to silinated silica of from about 19:1 to about 1:2. The silicone suds suppressing agent is advantageously releaseably incorporated in a water-soluble or water-dispersible, substantially nonsurface-active detergent impermeable carrier.

Particularly useful suds suppressors are the self-emulsifying silicone suds suppressors, described in U.S. Patent application Ser. No. 622,303, Gault et al, filed Oct. 14, 1975, now abandoned, incorporated herein by reference. An example of such a compound is DB-544, commercially available from Dow Corning, which is a siloxane/glycol copolymer.

Microcrystalline waxes having a melting point in the range of from 35° C. to 115° C. and saponification values less than 100, represent an additional example of a preferred suds regulating component for use in the subject compositions. The microcrystalline waxes are substantially water-insoluble, but are water-dispersible in the presence of organic surfactants. Preferred microcrystalline waxes have a melting point of from about 65° C. to 100° C., a molecular weight in the range of 400 to 1000, and a penetration value of at least 6, measured at 77° F. by ASTM-D1321. Suitable examples of the above waxes include: microcrystalline and oxidized microcrystalline petrolatum waxes; Fischer-Tropsch and oxidized Fischer-Tropsch waxes; ozokerite; ceresin; montan wax; beeswax; candelilla; and carnauba wax.

Alkyl phosphate esters represent an additional preferred suds suppressant for use herein. These preferred phosphate esters are predominantly monostearyl phosphate which, in addition thereto, can contain di-and tristearyl phosphates and monooleyl phosphates, which can contain di and trioleyl phosphates.

The alkyl phosphate esters frequently contain some trialkyl phosphate. Accordingly, a preferred phosphate ester can contain, in addition to the monoalkyl ester, e.g., monostearyl phosphate, up to about 50 mole percent of dialkyl phosphate and up to about 5 mole percent of trialkyl phosphate.

In addition to the components described hereinbefore, the compositions according to this invention can contain additional detergent composition ingredients which are known to be suitable for use in automatic dishwashing compositions, in the art established levels for their known functions. Organic and inorganic detergent builder ingredients, alkali materials, sequestering agents, china protecting agents, reducing agents, hydrotropes, corrosion inhibitors, soil-suspending ingredients, drainage promoting ingredients, dyes, perfumes, fillers, crystal modifiers and the like represent examples of functional classes of additional automatic dishwashing composition additives. Suitable inorganic builders include polyphosphates, for example tripolyphosphate, pyrophosphate, or metaphosphate, carbonates, bicarbonates, and alkali silicates. Particularly preferred are the sodium and potassium salts of the aforementioned inorganic builders. Examples of water-soluble organic builder components include the alkali metal salts of polyacetates, carboxylates, polycarboxylates, and polyhydroxy sulfonates. Additional examples include sodium citrate, sodium oxydisuccinate, and sodium mellitate. Normally these builder ingredients can be used in an amount of up to 60%, preferably in the range of from about 10% to 50% by weight.

Suitable examples of sequestering agents include alkali metal salts of ethylenediaminetetraacetic acid and nitrilotriacetic acid.

Examples of china protecting agents include silicates, water-soluble aluminosilicates and aluminates.

Carboxymethylcellulose is a well-known soil suspending agent for use in detergent compositions. Fillers useful in the detergent compositions are usually represented by sodium sulfate, sucrose, sucrose esters, and the like.

Pasty, gel-like or viscous liquid compositions can include many of the above-discussed additional ingredients, but usually at a lower level in view of the higher active concentration. In such compositions, materials which are favored as builders or to provide alkalinity include polyphosphates, carbonates, bicarbonates, silicates, alkanolamines, especially mono-, di-, and triethanolamine, and the organic builders and sequestering agents discussed above.

In order to provide satisfactory pasty compositions, a small amount, for example, up to 20%, of a solvent or solubilizing material or a gel-forming agent may be included. Most commonly, water is used in this context and forms the continuous phase of a concentrated dispersion. Certain nonionic detergents at high levels form a gel in the presence of small amounts of water and other solvents. Such gelled compositions are also envisaged in the present invention.

In many cases, it is desirable to include a viscosity control agent or a thixotropic agent to provide a suitable product form. For example, aqueous solutions or dispersions of the invention can be thickened or made thixotropic by the use of conventional agents such as methylcellulose, carboxymethylcellulose, starch, polyvinyl pyrrolidone, gelatin, colloidal silica, natural or synthetic clay materials, and the like.

In addition to the above optional detergent additives, the compositions of the present invention may also include various enzyme stabilizing agents known in the art. Examples of such stabilizing agents include polyhydroxyl compounds, such as sugar alcohols, monosaccharides and discaccharides, as disclosed in the specification of German Pat. No. 2,038,103, water-soluble sodium or potassium salts and water-soluble hydroxy alcohols, as disclosed in U.S. Published Patent Application B-458,819, Weber, published Apr. 13, 1976; diamines and polyamines, as disclosed in German Pat. No. 2,058,826; amino acids, as disclosed in German Pat. No. 2,060,485; and reducing agents, as disclosed in Japanese Pat. No. 72-20235. Further, in order to enhance its storage stability, the enzyme mixture may be incorporated into the detergent composition in a coated, encapsulated, agglomerated, prilled, or noodled form in accordance with, e.g., our copending application U.S. Ser. No. 699,417, filed June 24, 1976 Maguire and Pancheri, filed of even date.

The following examples are illustrative of the invention, but are not intended to be limiting thereof.

EXAMPLE I

Detergent compositions having the following formulae were prepared in a conventional manner:

| Ingredients | Composition in % by weight A | B | C |
|---|---|---|---|
| Condensation product of 1 mole tallow alcohol with 9 moles ethylene alcohol ($TAE_9$) | 10 | 10 | 10 |
| Sodium cumene sulfonate | 9.1 | 9.1 | 9.1 |
| Silicate solids ($SiO_2/Na_2O=2.4$) | 25 | 25 | 25 |
| Triethanolamine | 19 | 19 | 19 |
| Sodium carbonate | 5.2 | 5.2 | 5.2 |
| Sodium tripolyphosphate | 25 | 25 | 25 |
| Monostearyl acid phosphate | 1 | 1 | 1 |
| SP-72[1] | 1.2 | 0.6 | 0.6 |
| Termamyl[2] | — | 0.6 | 0.1 |
| Moisture and minors | | BALANCE | |

[1]proteolytic enzyme available from Novo Industries A/S, Copenhagen, Denmark. 3.0 Anson units/gram (8.0 Kilo Novo Protease Units/g.) of enzyme preparation. Exhibits an activity of greater than 80% of its maximum activity when measured at pH 12 using the Anson hemoglobin method in the presence of urea.

[2]Amylolytic enzyme available from Novo Industries A/S, Copenhagen Denmark. Available in solution or granular form, with activity of 66.2 Kilo Novo Units/q. Exhibits an amylolytic activity of greater than 50% of its maximum activity when measured at pH 8 by the SKB method at 37° C.

The above compositions were used for comparative cleaning evaluations according to the procedure described hereinafter.

Two sets of dishes were identically soiled with food (dried soils, baked soils, cooked soils) and were washed under identical conditions in automatic dishwashers. In one dishwasher the detergent composition of this invention was used and in the second dishwasher a commercially available chlorine bleach-containing detergent was used. The soiled dishes were loaded according to an established loading pattern, i.e., a dish soiled with a given soil was always placed in the same spot in the dishwasher. The soiled surfaces faced the water spray. The washed dishes were graded in a round robin design with the aid of a clean dish and a soiled dish to dimension the range of performance. A 0 to 4 scale was used to evaluate the performance differences, wherein 4 means that in the pair graded one dish was a whole lot better than the second; 3 means that one dish was a lot better than the second; 2 means that one dish was better than the second; 1 means that one dish was thought to be better than the second; and 0 means that both dishes were equal. The water hardness utilized for these tests was 15 U.S. grains per gallon, the washing temperature was 130° F., and the product concentration used was 0.3%.

The scores received by each of Compositions A, B, and C, defined above, were averaged out over a series of tests and the results are reported in the table below:

| Composition | Cleaning Grade Average (Panel Score Units) Protein Soils | Carbohydrate Soils | Total |
|---|---|---|---|
| A | +1.59 | +0.25 | +1.84 |
| B | +1.65 | +0.68 | +2.33 |
| C | +1.11 | +0.08 | +1.19 |

The results indicate, that the Composition B, which contained the enzyme mixture of the specially selected proteolytic and amylolytic enzymes in the proper ratio, yielded dramatically improved cleaning of carbohydrate soils and an improvement in protein soil cleaning, over Composition A, even though Composition A contained twice as much proteolytic enzyme as did Composition B.

Substantially similar results are obtained when the nonionic surfactant of Example I is substituted with an ethylene oxide/propylene oxide condensate of trimethylol propane (commercially available from Wyandotte as Pluradot HA-433), or with a similar surfactant substituted with a substantially identical alkoxylate containing, instead of the trimethylol propane radical, an alkalol selected from the group consisting of propylene glycol, glycerine, pentaerythritol, and ethylenediamine; or with the condensation product of $C_{14-15}$ alcohol with from about 5 to 17 moles of ethylene oxide.

Excellent performance is also obtained when the monostearyl acid phosphate of Example I is replaced by a silicone suds suppressant selected from the group consisting of trimethyl, diethyl-, dipropyl-, dibutyl-, methylethyl-, and phenylmethylpolysiloxane and mixtures thereof in an amount of 0.1%, 0.2%, 0.3%, 0.35%, 0.4%, and 0.45%, respectively. Similar results are also obtained using a self-emulsifying silicone suds suppressor, such as DE-544, available from Dow Corning.

Results substantially comparable to those of Example I can also be obtained when the suds suppressant is represented by a microcrystalline wax having a melting point from 65° C. to 100° C., and which is selected from petrolatum and oxidized petrolatum waxes; Fischer-Tropsch and oxidized Fischer-Tropsch waxes; ozokerite; ceresin; montan wax; beeswax; candelilla; and carnauba wax.

Substantially comparable results are obtained where the builder of Composition B is replaced by sodium or potassium pyrophosphate, metaphosphate, bicarbonate; an alkali metal salt of a polyacetate, carboxylate, polycarboxylate or a polyhydroxy sulfonate; sodium citrate, sodium oxydisuccinate or sodium mellitate.

Excellant results are also obtained when the proteolytic enzyme of Composition B is replaced by one cultivated from the bacterium strain NCIB 10317, NCIB 10147, NCIB 10313, NCIB 10315 or NRRL B 1107 or the amylolytic enzyme is replaced by one cultivated from the bacterium strain NCIB 8061, NCIB 8059, ATCC 6334, ATCC 6598, ATCC 11945, ATCC 8480, or ATCC 9945A.

EXAMPLE II

Detergent compositions having the following formulae were prepared in a conventional manner:

| Ingredients | Composition in % by weight | | | |
|---|---|---|---|---|
| | A | B | C | D |
| Condensate of one mole of $C_{14-15}$ alcohol with 7 moles of ethylene oxide (Neodol 45-7) | 5.8 | 5.8 | 5.8 | 5.8 |
| Silicate solids (2.4r) | 29 | 29 | 29 | 29 |
| Triethanolamine | 29 | 29 | 29 | 29 |
| Sodium tripolyphosphate · $6H_2O$ | 33 | 33 | 33 | 33 |
| DB544 (1) | 1 | 1 | 1 | 1 |
| SP-72 | 1.2 | — | — | — |
| SP-88 (2) | — | 1.2 | 0.6 | — |
| Alcalase (3) | — | — | — | 0.6 |
| Termamyl | — | — | 0.6 | 0.6 |
| Minors | Balance to 100% | | | |

(1) a self-emulsifying silicone suds suppressor available from Dow Corning.

(2) a proteolytic enzyme available from Novo Industries A/S. Copenhagen, Denmark, as a slurry in Tergitol 15S9, with an activity of 8.0 Kilo Novo Protease Units/g. (approx. 3.0 Anson units/g). Exhibits an activity of greater than 80% of its maximum activity when measured at pH 12 using the Anson hemoglobin method in the presence of urea.

(3) a proteolytic enzyme (4.0 Anson units/g.) available from Novo Industries A/S, which does not exhibit an activity of greater than 80% of its maximum activity when measured at pH 12 using the Anson hemoglobin method in the presence of urea.

Compositions A, B, C, and D, were tested using the test method and scoring procedure described above in Example I. The results are summarized in the table below:

| Composition | Cleaning Grade Average (Panel Score Units) | |
|---|---|---|
| | Protein Soils | Carbohydrate Soils |
| A | +1.68 | +0.31 |
| B | +1.65 | +0.25 |
| C | +1.69 | +0.66 |
| D | +0.39 | +0.50 |

It is seen that Composition C, containing the specially selected proteolytic and amylolytic enzyme, provided markedly improved cleaning of carbohydrate soils together with protein soil cleaning which was comparable to Compositions A and B with half the proteolytic enzyme necessary. Composition D indicates the decline in cleaning performance which occurs when the enzyme mixture contains a proteolytic enzyme which does not fall within the specially defined class of proteolytic enzymes.

EXAMPLE III

A granular detergent composition for use in automatic dishwashers is formulated having the following composition:

| Component | Weight % |
|---|---|
| Condensate of tallow alcohol with 9 moles ethylene oxide | 8.0 |
| Sodium cumene sulfonate | 5.0 |
| Silicate (2.8r) | 17.0 |
| Sodium tripolyphosphate (anhydrous) | 36.0 |
| SP-88 | 0.3 |
| Tormamyl | 0.3 |
| Water and minors | 20.0 |
| SAG-100 (1) | 0.75 |
| Sodium sulfate | balance to 100 |

(1) a polydimethyl siloxane silica suds suppressor, available from Dow Corning.

EXAMPLE IV

A paste detergent composition for use in automatic dishwashers, having the following composition, is formulated:

| Component | Weight % |
|---|---|
| Neodol 45-7 | 5.8 |

-continued

| Component | Weight % |
|---|---|
| DB-544 | 0.8 |
| Silicate solids (2.0r) | 14.0 |
| Triethanolamine | 27.0 |
| Anhydrous sodium tripoly-phosphate | 35.0 |
| SP-72 | 0.6 |
| Milezyme (1) | 0.6 |
| Water and minors | balance to 100 |

(1) an amylolytic enzyme available from Miles Laboratories, Elkhart, Ind., which exhibits activity greater than 50% of maximum activity when measured at pH 8 by the SKB method at 37° C.

In the above detergent composition, the proteolytic enzyme SP-72 may be replaced by SP-88, and the amylolytic enzyme Milezyme may be replaced by Termamyl.

EXAMPLE V

A paste-form detergent composition for use in automatic dishwashers, having the following composition, is formulated:

| Component | Weight % |
|---|---|
| Ethylene oxide/propylene oxide condensate of tri-methylol propane | 25.0 |
| Sodium cumene sulfonate | 10.0 |
| Silicate solids (2.0r) | 12.0 |
| Triethanolamine | 19.0 |
| Anhydrous sodium tripoly-phosphate | 25.0 |
| SP-88 | 0.8 |
| Termamyl | 0.4 |
| Monostearyl acid phosphate | 0.75 |
| DB544 | 0.25 |
| Water and minors | balance to 100 |

EXAMPLE VI

A gel detergent composition for use in automatic dishwashers, having the following composition, is formulated:

| Component | Weight % |
|---|---|
| $tae_9$ | 7.9 |
| Silicate solids (2.0r) | 32.0 |
| Sodium tripolyphosphate | 19.8 |
| SP-88 | 0.4 |
| Termamyl | 0.8 |
| Water and minors | balance to 100 |

EXAMPLE VII

A granular detergent composition for use in automatic dishwashers, having the following composition, is formulated:

| Component | Weight % |
|---|---|
| $TAE_9$ | 3.5 |
| Sodium cumene sulfonate | 2.5 |
| Silicate solids (2.0r) | 20.0 |
| Sodium carbonate | 20.0 |
| Sodium bicarbonate | 10.0 |
| SP-72 | 0.4 |
| Termamyl | 0.2 |
| Sodium sulfate | 35.0 |

-continued

| Component | Weight % |
|---|---|
| Water and minors | balance to 100 |

What is claimed is:

1. A cleaning composition, particularly suitable for use in automatic dishwashers, consisting essentially of:

(a) from about 0.5% to about 20% of an alkoxylated nonionic surface-active agent selected from the group consisting of:

(i) the condensation product of one mole of a carboxylic acid having from about 10 to about 18 carbon atoms with from about 5 to about 50 moles of ethylene oxide;

(ii) the condensation product of an alcohol having from about 10 to about 24 carbon atoms with from about 5 to about 50 mols of ethylene oxide;

(iii) polyethylene glycol having a molecular weight of from about 1400 to about 30,000;

(iv) the condensation product of one mole of alkyl phenol wherein the alkyl chain contains from about 8 to about 18 carbon atoms with from about 4 to about 50 moles of ethylene oxide;

(v) the condensation product of benzyl chloride and an ethoxylated alkyl phenol wherein the alkyl group has from about 6 to about 12 carbon atoms and wherein from about 12 to about 20 moles of ethylene oxide have been condensed per mole of alkyl phenol;

(vi) polyetheresters of the formula $$(ClC_6H_4)_2\ CHCO_2\ (CH_2.CH_2.O)_xR$$

wherein x is from 4 to 20 and R is an alkyl group with from 1 to 4 carbon atoms;

(vii) polyoxyalkylene compounds of the formula $$Y[(C_3H_6O)_n(C_2H_4O)_mH]_x$$

wherein Y is an organic radical having from about 1 to about 18 carbon atoms and containing x reactive hydrogen atoms and the values of n and m are such that the $(C_2H_4O)$ content is from about 10% to about 90% by weight (viii) the alkoxylated nonionic surface-active agents having the formula (i) through (vii) in which the terminal hydroxyl of the alkoxy group is acylated with a monobasic acid; and (ix) mixtures thereof (b) from about 0.001% to about 5% of an enzyme mixture which consists essentially of:

(i) a proteolytic enzyme having a proteolytic activity of 80% to 100% of maximum activity when measured at pH 12 using the Anson Hemoglobin method carried out in the presence of urea; and (ii) an amylolytic enzyme which exhibits an amylolytic activity of greater than 50% of maximum when measured at pH 8 by the SKB method at 37° C., wherein said enzymes are present in a ratio of from about 4:1 to about 1:4 by weight, and wherein said enzyme mixture is present in such an amount that the final cleaning composition has an amylolytic activity of at least 150 Kilo Novo units per kilogram and a proteolytic activity of at least 6.0 Anson units per kilogram;

(c) from 0% to about 5% of a suds-regulating agent selected from the group consisting of:

(i) a siloxane having the formula:

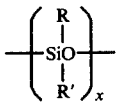

wherein x is from about 20 to about 2,000 and R and R′ are each alkyl or aryl groups selected from the group consisting of methyl, ethyl, propyl, butyl and phenyl;

(ii) A microcrystalline wax having a melting point in the range from about 35° C. to about 115° C. and a saponification value of less than 100;

(iii) an alkyl phosphate ester component selected from the group consisting of stearyl acid phosphate and oleyl acid phosphate;

(iv) a siloxane/glycol copolymer self-emulsifying suds suppressor; and (v) mixtures thereof;

(d) from 0% to about 60% of a detergent builder selected from the group consisting of sodium and potassium polyphosphates, carbonates, bicarbonates, alkali silicates, polyacetates, carboxylates, polycarboxylates, polyhydroxysulfonates and mixtures thereof; and (e) from 0% to about 20% water.

2. A composition according to claim 1 which is free of bleaching components.

3. A composition according to claim 1 which contains from about 0.1% to about 1.5% of the enzyme mixture.

4. A composition according to claim 3 having a pH during use of from about 9 to about 11.

5. A composition according to claim 4 having a pH during use of from about 9.5 to about 10.5.

6. A composition according to claim 1 wherein the amylolytic enzyme is one cultivated from the strains of bacillus lichenformis selected from the group consisting of NCIB 8061, NCIB 8059, ATCC 6334, ATCC 6598, ATCC 11945, ATCC 8480, ATCC 9945A and mixtures thereof.

7. A composition according to claim 6 wherein the proteolytic enzyme is one cultivated from a bacterium strain selected from the group consisting of NCIB 10317, NCIB 10147, NCIB 10313, NCIB 10315, NRRL B 1107 and mixtures thereof.

8. A composition according to claim 7 wherein the proteolytic enzyme is one cultivated from a bacterium strain selected from the group consisting of NCIB 10147, NRRL B 1107 and mixtures thereof.

9. A composition according to claim 7 wherein the ratio of proteolytic enzyme to amylolytic enzyme is about 2:1 to 1:2 by weight.

* * * * *